US007406895B2

(12) United States Patent
Hu

(10) Patent No.: US 7,406,895 B2
(45) Date of Patent: Aug. 5, 2008

(54) ANTI-SLIP SOCKET WITH UNIFORM WALL THICKNESS

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 0 days.

(21) Appl. No.: 11/758,317

(22) Filed: Jun. 5, 2007

(65) Prior Publication Data

US 2008/0028897 A1 Feb. 7, 2008

(30) Foreign Application Priority Data

Aug. 4, 2006 (TW) ..... 95128782 A

(51) Int. Cl.
*B25B 13/06* (2006.01)

(52) U.S. Cl. ..... 81/121.1; 81/124.6

(58) Field of Classification Search ..... 81/121.1, 81/124.3, 124.6, 124.4, 124.5, 119; D8/21, D8/29

See application file for complete search history.

(56) References Cited

U.S. PATENT DOCUMENTS 876,675 A * 1/1908 Albrecht ..... 81/121.1
D381,247 S * 7/1997 Zayat, Jr. ..... D8/29
6,282,994 B1 * 9/2001 Wei ..... 81/121.1
6,951,156 B2 * 10/2005 Garg ..... 81/121.1
D525,496 S * 7/2006 Hsieh ..... D8/29
7,127,969 B2 * 10/2006 Hsieh ..... 81/121.1
2003/0126960 A1 7/2003 Chen ..... 81/121.1

* cited by examiner

*Primary Examiner*—Hadi Shakeri
(74) *Attorney, Agent, or Firm*—Alan Kamrath; Kamrath & Associates PA

(57) ABSTRACT

A socket includes a coupling end coupled with and driven by a driving tool and a driving end for engaging with a fastener to be driven. The driving end includes a peripheral wall portion having six inner faces on an inner periphery thereof for coupling with and driving the fastener A recessed portion is formed between a pair of inner faces adjacent to each other. The peripheral wall portion further includes six concave outer faces on an outer periphery thereof and respectively opposite to the inner faces. A convex gripping portion is formed between a pair of concave outer faces adjacent to each other. The concave outer faces and the convex gripping portions form a non-smooth outer periphery of the peripheral wall portion to allow firm grip by a user.

3 Claims, 9 Drawing Sheets

ANTI-SLIP SOCKET WITH UNIFORM WALL THICKNESS

BACKGROUND OF THE INVENTION

The present invention relates to a socket for use with a socket wrench and, more particularly, to an anti-slip socket with uniform wall thickness.

FIGS. 1 and 2 illustrate a typical socket I for use with a socket wrench. The socket 1 includes a peripheral wall 2 defining a hexagonal hole 3 for receiving a fastener to be tightened or loosened. The peripheral wall 2 has a cylindrical outer surface too smooth to provide reliable gripping if the user's hand is dirtied by oil. Replacement of sockets of various sizes is often required during use. Sockets of this type are liable to roll on a slanted face if not properly placed (see FIG. 2), leading to troubles during use. Furthermore, the wall thickness of the peripheral wall 2 is not uniform and, thus, causes stress concentration while driving a fastener, leading to adverse effect to structural strength and driving effect of the socket 1. Furthermore, the socket 1 is usually made of metal and, thus, weighty to the user.

US 2003/0126960 A1 discloses a socket including a socket body having a driving portion with an outer peripheral face that has six flat or slightly convex surface surfaces and six rounded or convex corners formed therein, and parallel to the six flat or slightly convex surfaces and the six rounded or concave corners of an inner peripheral surface respectively. The peripheral wall of the driving portion includes a uniform-n thickness formed through or around the peripheral portion thereof. However, the rounded or concave corners on the outer peripheral face of the socket are too smooth to provide a firm grip by the user.

It is therefore a need in a socket that has improved structural strength and that is less weighty while allowing easy use and reliable gripping.

BRIEF SUMMARY OF THE INVENTION

The present invention solves this need and other problems in the field of sockets by providing, in a preferred form, a socket including a coupling end adapted to be coupled with and driven by a driving tool; and a driving end adapted to engage with a fastener to be driven. The driving end includes a peripheral wall portion having six inner faces on an inner periphery thereof for coupling with and driving the fastener. A recessed portion is formed between a pair of inner faces adjacent to each other. The peripheral wall portion further includes six concave outer faces on an outer periphery thereof and respectively opposite to the inner faces. A convex gripping portion is formed between a pair of concave outer faces adjacent to each other. The concave outer faces and the convex gripping portions form a non-smooth outer periphery of the peripheral wall portion. A ridge-shaped end edge is formed between each concave outer face and one of the convex gripping portions adjacent to the concave outer face. The ridge-shaped end edge is adapted to provide a user's hand holding the socket with friction. A first thickness is defined between an intermediate portion of one of the inner faces and an intermediate portion of one of the concave outer faces opposite to the inner face. A second thickness is defined between an intermediate portion of one of the recessed portions and an intermediate portion of one of the convex gripping portions opposite to the recessed portion. A third thickness is defined between one of the ridge-shaped end edges and an end of one of the recessed portions opposite to the ridge-shaped end edge. The first thickness is substantially the same as the second thickness, which, in turn, is substantially the same as the third thickness. Thus, the peripheral wall portion has a substantially uniform wall thickness throughout a periphery thereof.

The socket has an outer radius of a first circle that has a first center. Each concave outer face is an arc of a second circle having a second center. A distance between the first and second centers is smaller than a sum of the outer radius of the socket and radius of the second circle. A ratio of the radius of the second circle to the outer radius of the first circle is in a range between 2.01:1 and 5.08:1. A ratio of a distance between the first and second centers to the outer radius of the first circle is in a range between 2.91:1 and 6.01:1.

In another preferred form, the inner faces are planar, the recessed portions and the convex gripping portions are arc-shaped, and each concave outer face includes a planar intermediate section and two planar end sections extending away from each other from two ends of the planar intermediate section and at an acute angle with the planar intermediate section.

In the most preferred form, a difference between a radius of a circumscribed circle of the recessed portions and a radius of an inscribed circle of the concave outer faces is substantially in a range between one third and two thirds of the first thickness.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
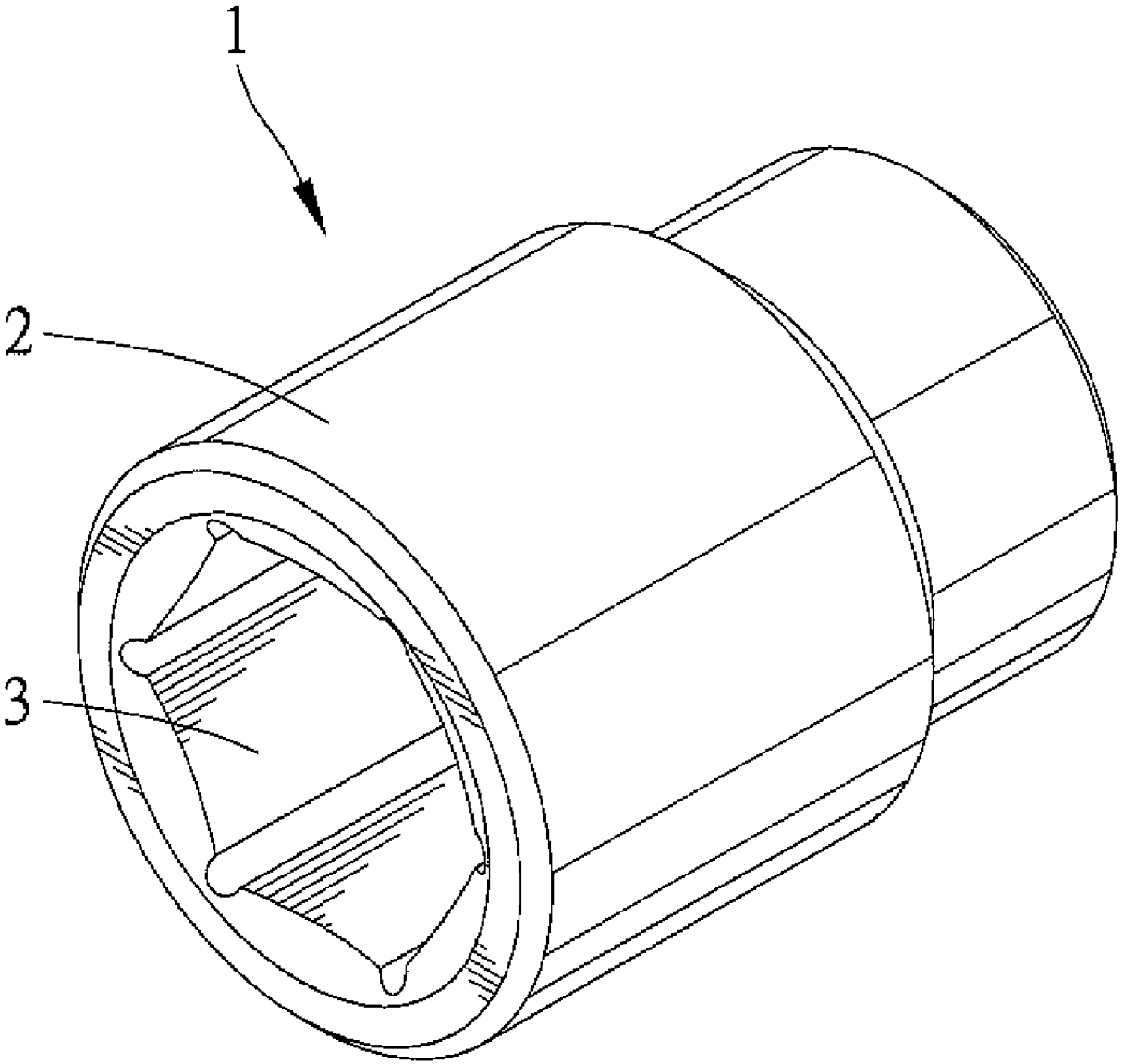
Fig. 1 PRIOR ART
FIG. 1 shows a perspective view of a conventional socket.
Figure 2:
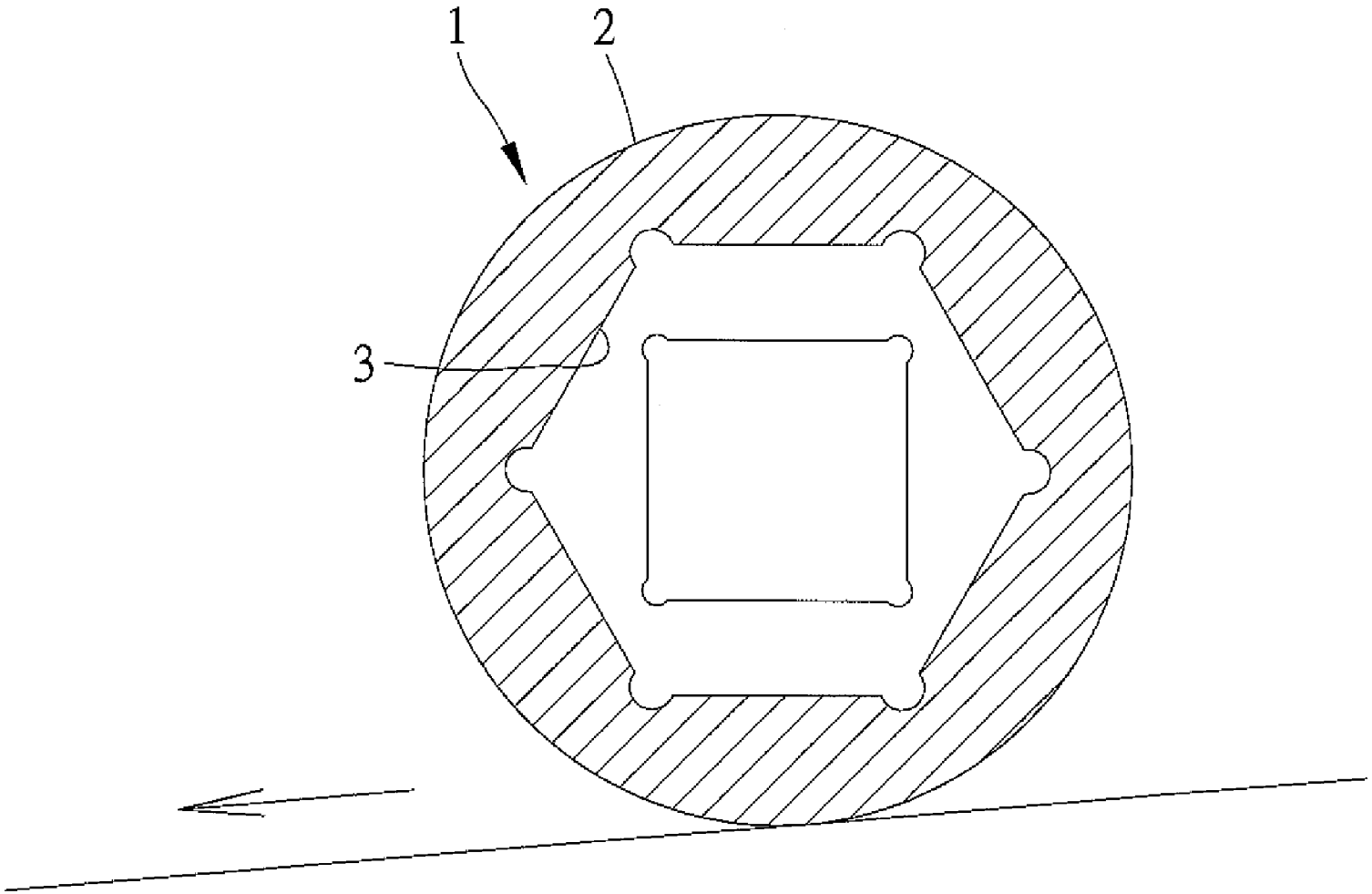
Fig. 2 PRIOR ART
FIG. 2 shows rolling of the socket of FIG. 1 on a slanted face.
Figure 3:
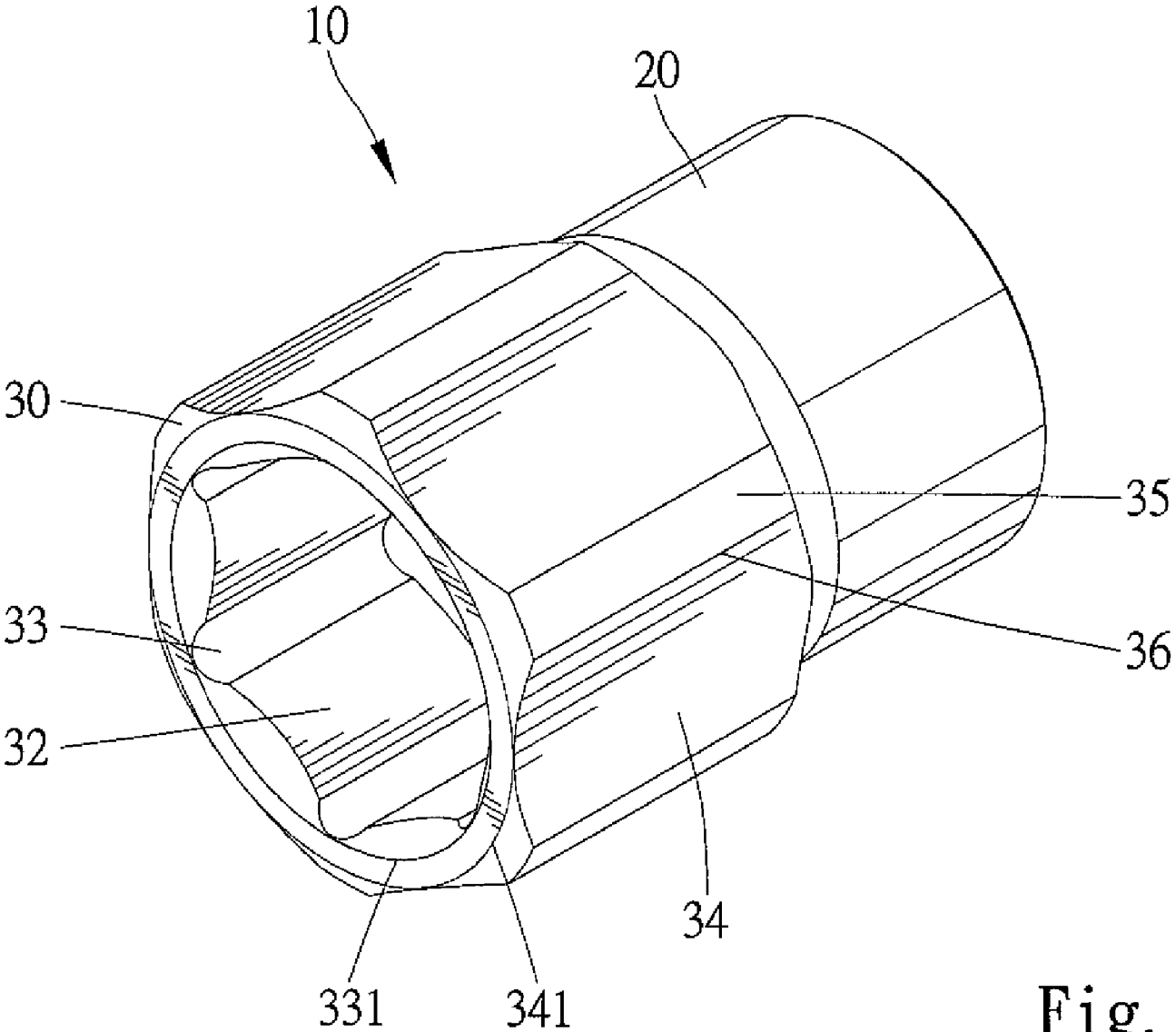
FIG. 3 shows a perspective view of a socket according to the preferred teachings of the present invention.
Figure 4:
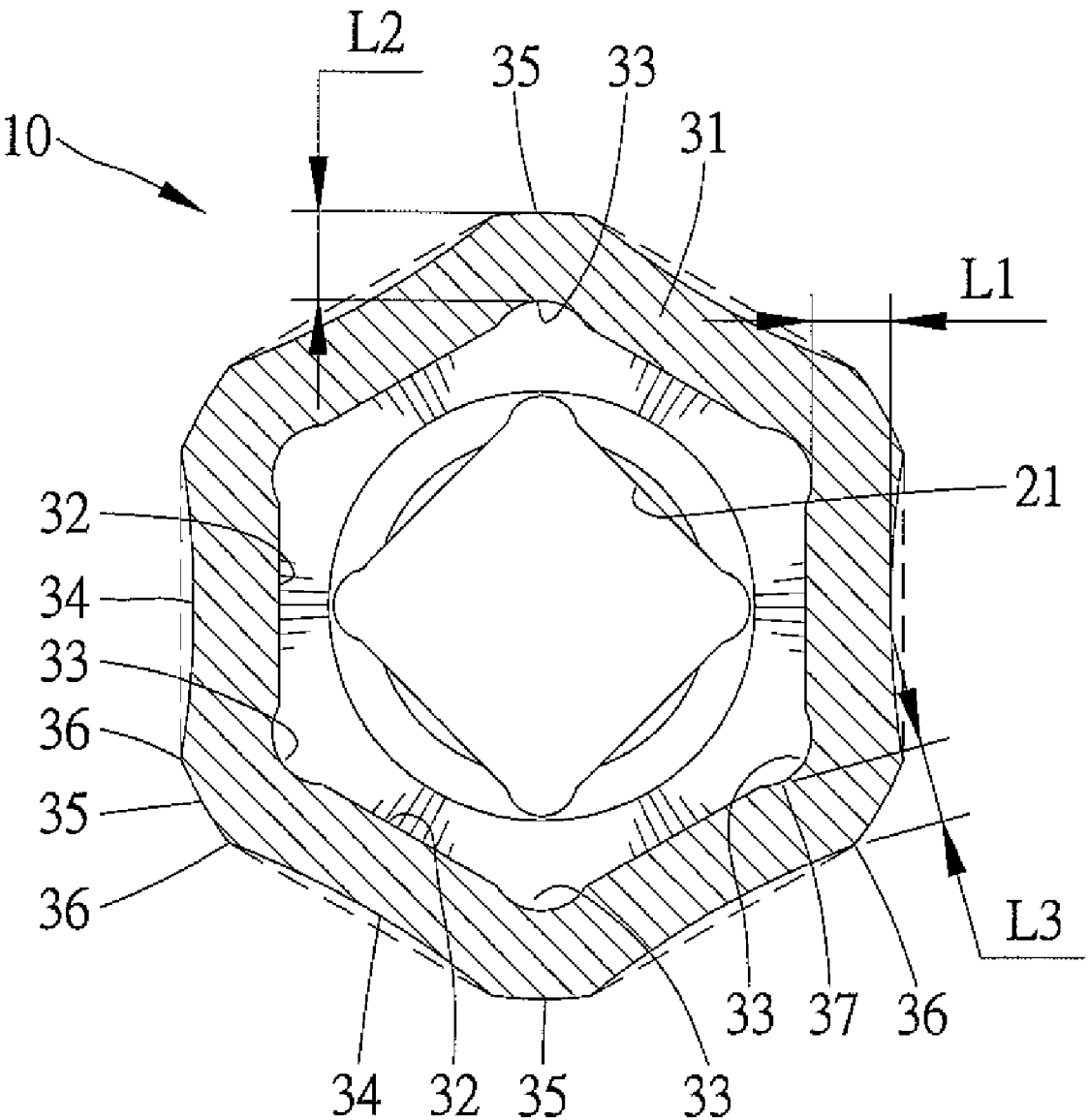
FIG. 4 shows a sectional view of the socket of FIG. 3.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "end", "edge", "portion", "section", "width", "thickness", "concave", "convex", "planar", "arc", "ridge", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A socket according to the preferred teachings of the present invention is shown in FIGS. 3 to 8 of the drawings and generally designated 10. The socket 10 is adapted to releasably couple with a driving tool such as a socket wrench for tightening or loosening a fastener such as a bolt, nut, or the like.

In the preferred form shown, the socket 10 includes a coupling end 20 having a square hole 21 with a size to be coupled with and driven by a drive column of a socket wrench or the like. The socket 10 further includes a driving end 30 opposite to the coupling end 20. The driving end 30 includes a peripheral wall portion 31 having a plurality of planar inner faces 32 on an inner periphery thereof for coupling with and driving a fastener. In the most preferred form shown, the peripheral wall portion 31 is hexagonal and includes six planar inner faces. A larger contact area is provided between the driving end 30 and the fastener due to provision of the planar inner faces 32. Thus, higher efficiency is obtained in transmission of driving torque from the wrench through the socket 10 to the fastener. A recessed portion 33 is formed between a pair of inner faces 32 adjacent to each other. These recessed portions 33 receive and, thus, prevent damage to the corners of the fastener. In the most preferred form shown, the recessed portions 33 are arc-shaped.

The peripheral wall portion 31 of the driving end 30 further includes six concave outer faces 34 on an outer periphery thereof and respectively opposite to the six planar inner faces 32. A convex gripping portion 35 is formed between a pair of concave outer faces 34 adjacent to each other. The concave outer faces 34 and the convex gripping portion 35 allow a user to firmly grip the socket 10. In the most preferred form shown, the concave outer faces 34 and the convex gripping portions 35 are arc-shaped. This allows the user to directly drive a fastener coupled in a compartment (not labeled) defined by the inner faces 32. A ridge-shaped end edge 36 is formed between each concave outer face 34 and one of the convex gripping portions 35 adjacent to the concave outer face 34. Namely, twelve ridge-shaped end edges 36 are formed on the outer periphery of the peripheral wall portion 31. Each concave outer face 34 is below a plane including a pair of two end edges 36 between which the concave outer face 34 is located (see FIG. 4). This provides the user with enhanced friction while manually driving a fastener with the socket 10.

A first thickness L1 is defined between an intermediate portion of an inner face 32 and an intermediate portion of one of the concave outer faces 34 opposite to the inner face 32. A second thickness L2 is defined between an intermediate portion of a recessed portion 33 and an intermediate portion of one of the convex gripping portions 35 opposite to the recessed portion 33. A third thickness L3 is defined between a ridge-shaped end edge 36 and an end 37 of one of the recessed portions 33 opposite to the ridge-shaped end edge 36. Namely, the peripheral wall portion 31 has a substantially uniform wall thickness throughout a periphery thereof.

Although these thicknesses L1, L2, and L3 may not be exactly identical due to tolerances, the differences between the thicknesses L1, L2, and L3 are within an acceptable tolerance limit, providing a substantially uniform wall thickness for the peripheral wall portion 31. Concentration of stress occurs easily in an area having large thickness difference. The socket 10 according to the preferred teachings of the present invention has no such problem due to provision of the peripheral wall portion 31 with a uniform wall thickness. Namely, the socket 10 according to the preferred teachings of the present invention has uniform structural strength without weak points.

Figure 5:
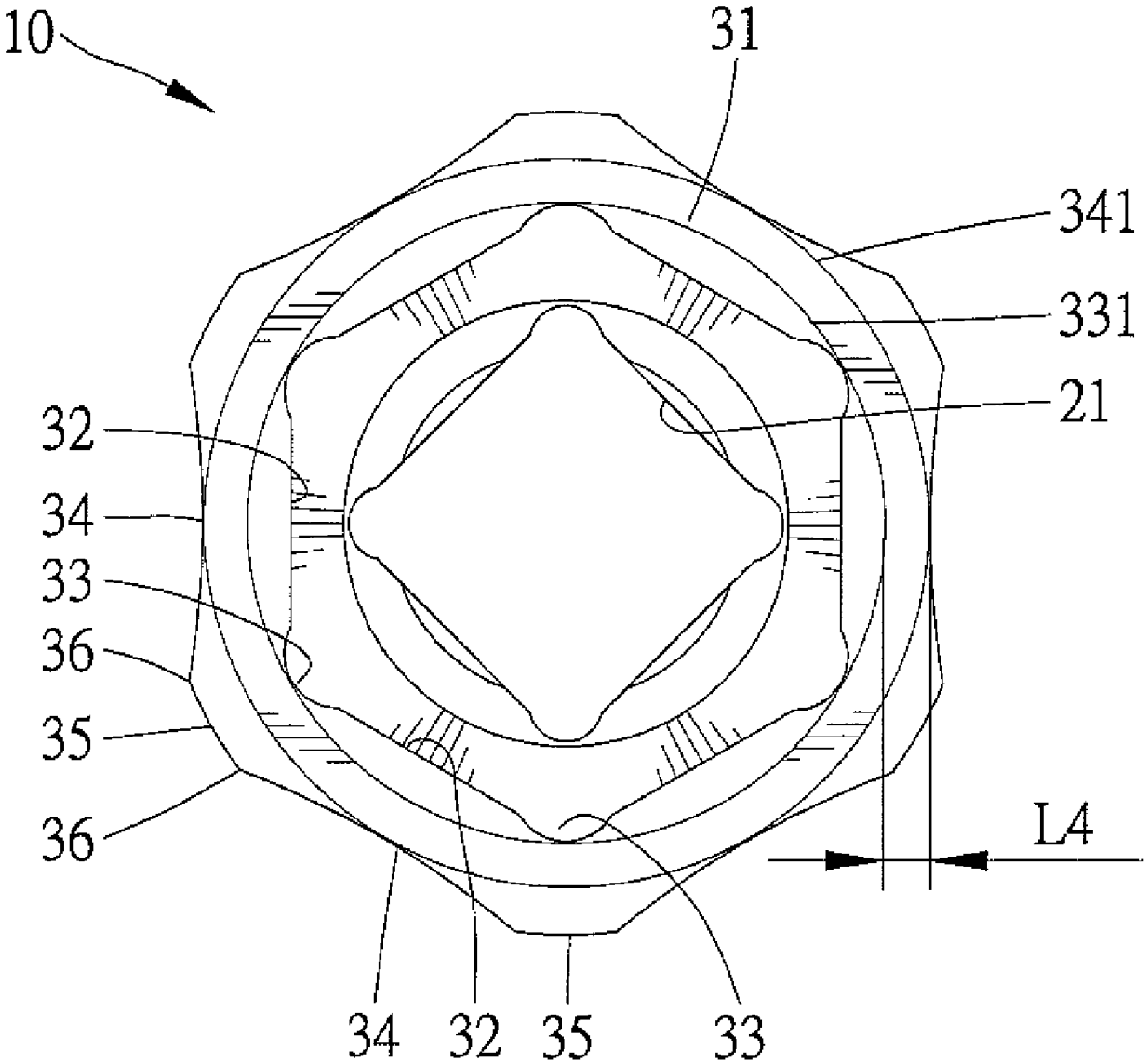
FIG. 5 shows a front elevational view of the socket of FIG. 3.

With reference to FIG. 5, a distance L4 is defined between a circumradius (i.e., the radius of a circumscribed circle 331) of the recessed portions 33 and a radius of an inscribed circle 341 of the concave outer faces 34. Namely, a solid ring-shaped area exists in the peripheral wall portion 31 and has a width (i.e., the distance L4) in a range between one third and two thirds of the first, second, or third thickness L1, L2, or L3. This avoids excessive depression of the concave outer faces 34 in the outer periphery of the peripheral wall portion 31 while providing reinforced structure to avoid concentration of stress.

The peripheral wall portion 31 of the driving end 30 of the socket 10 according to the preferred teachings of the present invention includes the first thickness L1 in six areas, the second thickness L2 in six areas, and the third thickness L3 in twelve areas, all of which are substantially the same to provide a uniform thickness throughout the peripheral wall portion 31. Namely, the peripheral wall portion 31 has identical thickness in at least twenty four areas. The stress imparted to the peripheral wall portion 31 is effectively distributed to these areas, avoiding stress concentration and damage to the structure. Accordingly, the structural strength of the socket 10 is enhanced and the life of the socket 10 is prolonged.

Figure 6:
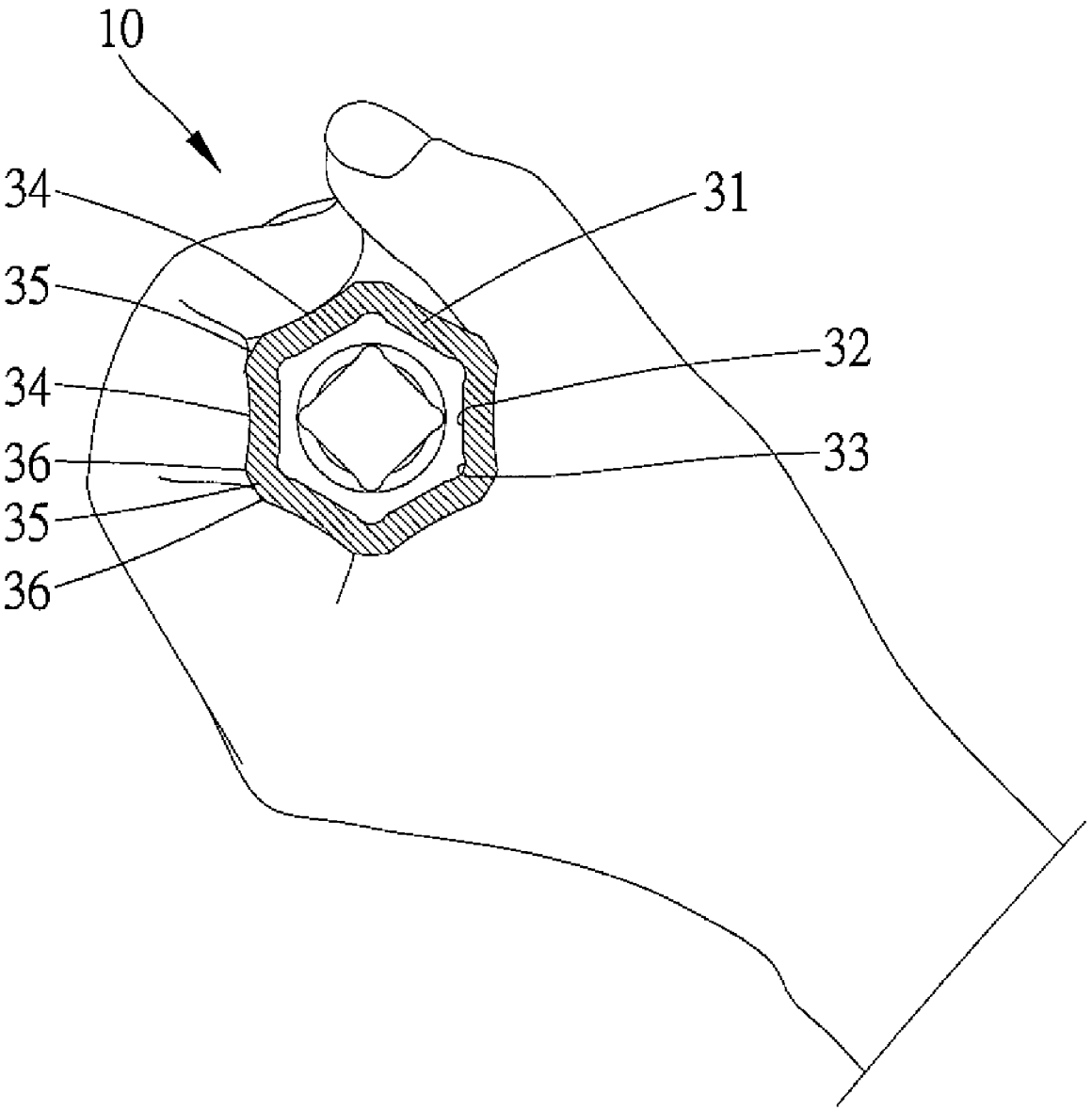
FIG. 6 shows a schematic sectional view of the socket of FIG. 3 gripped by a user.
Figure 7:
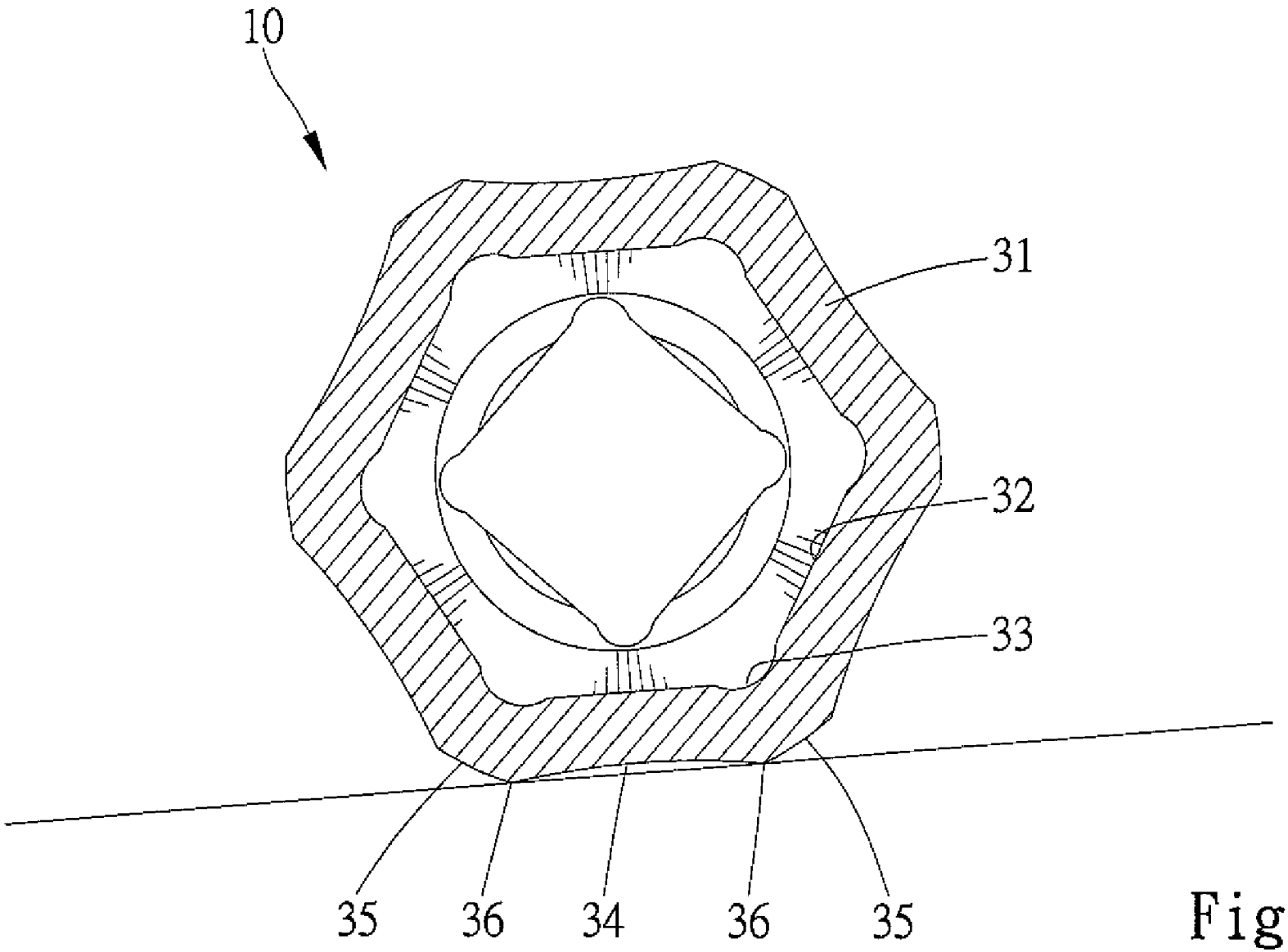
FIG. 7 shows the socket of FIG. 3 stably rested on a slanted face.

A reliable anti-slipping effect is provided at the outer periphery of the peripheral wall portion 31 due to provision of the concave outer faces 34, the convex gripping portions 35, and the ridge-shaped end edges 36. With reference to FIG. 6, in use, the concave outer faces 34 and the convex gripping portions 35 allow intimate contact with the user's hand in a large contact area whereas the ridge-shaped end edges 36 provide the user's hand with large friction. Thus, the user may directly drive a fastener with the socket 10 according to the preferred teachings of the present invention. Unlike the smooth outer periphery of conventional sockets, the outer periphery of the peripheral wall portion 31 of the socket 10 according to the preferred teachings of the present invention is not smooth and, thus, provides a reliable anti-slipping effect even if oil exists on the outer periphery of the peripheral wall portion 31. With reference to FIG. 7, another advantage of the non-smooth outer periphery of the peripheral wall portion 31 of the socket 10 according to the preferred teachings of the present invention is that the socket 10 can be stably placed on a slanted face without the risk of rolling. This allows use of the socket 10 according to the preferred teachings of the present invention in various working environments. Furthermore, the overall weight of the socket 10 according to the preferred teachings of the present invention is lighter than conventional sockets due to provision of the concave outer faces 34, allowing easy carriage of a whole set of sockets 10.

Figure 9:
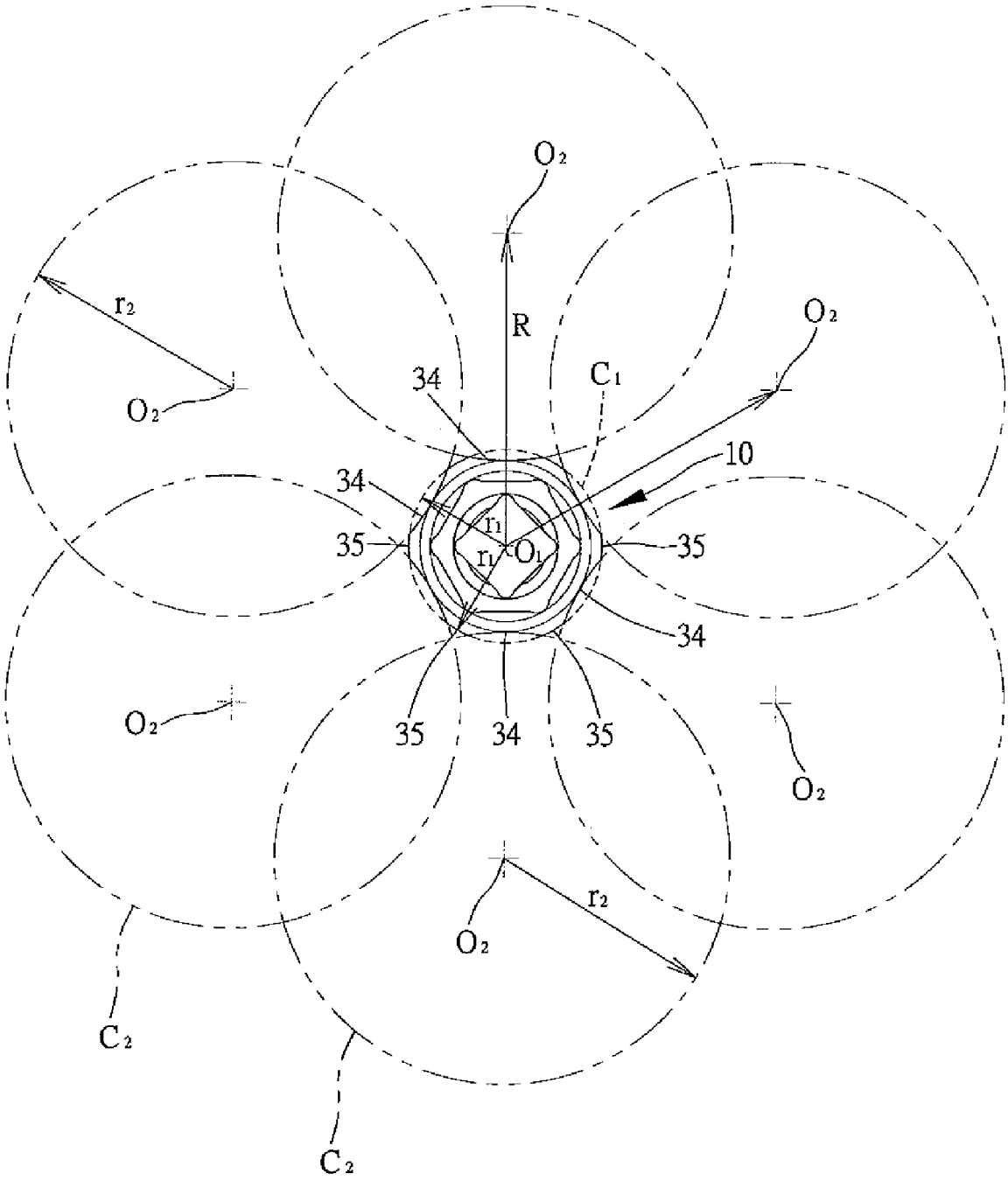
FIG. 9 shows a relationship between centers of concave outer faces and a center of convex gripping portions on an outer periphery of the socket of FIG. 3.

With reference to FIG. 9, in the preferred form shown, the socket 10 has an outer radius $r_1$ of a first circle $C_1$ that has a center at $O_1$ and that defines the outer periphery of the socket 10, and each convex gripping portion 35 is an arc of the first circle $C_1$. Each concave outer face 34 is an arc of a second circle $C_2$ having a center at $O_2$ and a radius $r_2$. A distance R between the centers $O_1$ and $O_2$ is smaller than the sum of the outer radius $r_1$ of the socket 10 and the radius $r_2$ of the second circle $C_2$. A ratio of $r_2$ to r, is in a range between 2.01:1 and 5.08:1 whereas a ratio of R to $r_1$ is in a range between 2.91:1 and 6.01:1.

Figure 8:
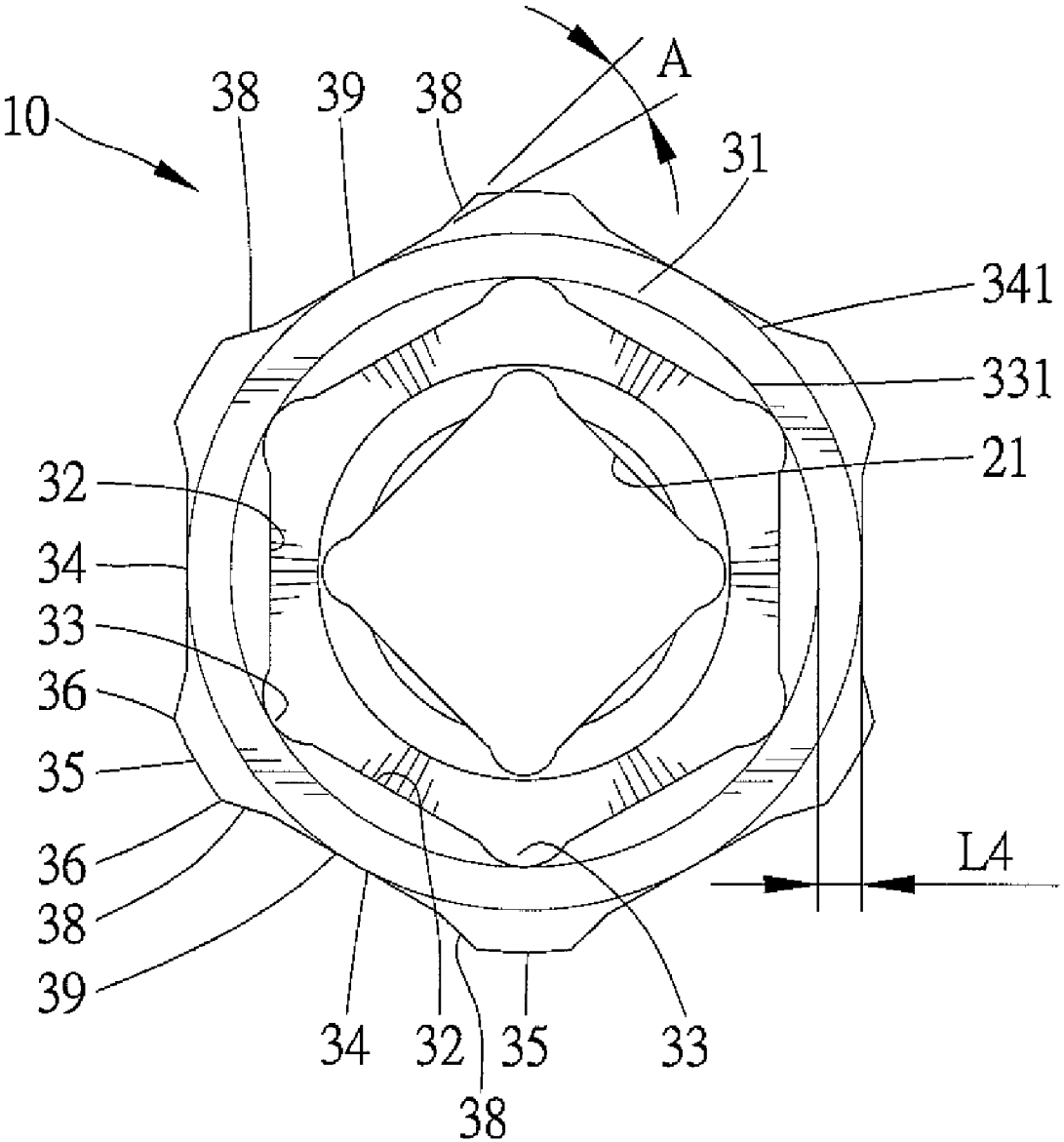
FIG. 8 shows a modified example of the socket according to the preferred teachings of the present invention.

FIG. 8 illustrates a modified embodiment of the socket 10 according to the preferred teachings of the present invention. In this embodiment, each concave outer face 34 of the peripheral wall portion 31 includes a planar intermediate section 39 and two planar end sections 38 extending away from each other from two ends of the planar intermediate section 39 and at an acute angle A with the planar intermediate section 39 while maintaining uniform thickness of the peripheral wall portion 31.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A socket comprising:

a coupling end adapted to be coupled with and driven by a driving tool; and a driving end adapted to engage with a fastener to be driven, with the driving end comprising a peripheral wall portion having six inner faces on an inner periphery thereof for coupling with and driving the fastener, with a recessed portion being formed between a pair of inner faces adjacent to each other, with the peripheral wall portion further comprising six concave outer faces on an outer periphery thereof and respectively opposite to the inner faces, with a convex gripping portion being formed between a pair of concave outer faces adjacent to each other, and with the concave outer faces and the convex gripping portions forming a non-smooth outer periphery of the peripheral wall portion;

with the peripheral wall portion further including a ridge-shaped end edge formed between each said concave outer face and one of the convex gripping portions adjacent to the concave outer face, with the ridge-shaped end edge being adapted to provide a user's hand holding the socket with friction, with a first thickness being defined between an intermediate portion of one of the inner faces and an intermediate portion of one of the concave outer faces opposite to the inner face, with a second thickness being defined between an intermediate portion of one of the recessed portions and an intermediate portion of one of the convex gripping portions opposite to the recessed portion, with a third thickness being defined between one of the ridge-shaped end edges and an end of one of the recessed portions opposite to the ridge-shaped end edge, with the first thickness being substantially the same as the second thickness, with the second thickness being substantially the same as the third thickness, with the socket having an outer radius of a first circle that has a first center, with each concave outer face being an arc of a second circle having a second center and a radius, with a distance between the first and second centers being smaller than a sum of the outer radius of the socket and the second radius of the second circle, with a ratio of the radius of the second circle to the outer radius of the first circle being in a range between 2.01:1 and 5.08:1, and with a ratio of the distance between the first and second centers to the outer radius of the first circle being in a range between 2.91:1 and 6.01:1.

2. The socket as claimed in claim 1, with a difference between a radius of a circumscribed circle of the recessed portions and a radius of an inscribed circle of the concave outer faces being substantially in a range between one third and two thirds of the first thickness.

3. The socket as claimed in claim 1, with the inner faces being planar, with the recessed portions being arc-shaped, and with each said convex gripping portion being an arc of the first circle.

* * * * *